US005491056A

United States Patent [19]

Wen et al.

[11] Patent Number: 5,491,056

[45] **Date of Patent: * Feb. 13, 1996**

[54] PROCESS OF FORMING A PHOTOGRAPHIC EMULSION

[75] Inventors: Xin Wen; Roger Lok, both of Rochester, N.Y.

[73] Assignee: Eastman Kodak Company, Rochester, N.Y.

[ * ] Notice: The portion of the term of this patent subsequent to Feb. 14, 2012, has been disclaimed.

[21] Appl. No.: 296,567

[22] Filed: Aug. 26, 1994

[51] Int. Cl.[6] ..... G03C 1/07; G03C 1/035

[52] U.S. Cl. ..... 430/569; 430/567; 430/600; 430/607; 430/613; 430/614

[58] Field of Search ..... 430/567, 569, 430/600, 613, 607, 614

[56] References Cited

U.S. PATENT DOCUMENTS

| | | | |
|---|---|---|---|
| T103,803 | 1/1984 | Lok et al. | 430/505 |
| T104,903 | 12/1984 | Lok et al. | 540/1 |
| 4,115,122 | 9/1978 | Adachi et al. | 430/598 |
| 4,256,830 | 3/1981 | Jäger et al. | 430/372 |
| 4,378,426 | 3/1983 | Lok et al. | 430/505 |
| 4,451,557 | 5/1984 | Lok et al. | 430/505 |
| 4,643,966 | 2/1987 | Maskasky | 430/567 |
| 4,680,254 | 7/1987 | Maskasky | 430/567 |
| 4,680,255 | 7/1987 | Maskasky | 430/567 |
| 4,680,256 | 7/1987 | Maskasky et al. | 430/567 |
| 4,683,192 | 7/1987 | Nishiyama | 430/567 |

(List continued on next page.)

*Primary Examiner*—Charles L. Bowers, Jr.
*Assistant Examiner*—Mark F. Huff
*Attorney, Agent, or Firm*—Peter C. Cody

[57] ABSTRACT

A process is disclosed for preparing a photographic emulsion utilizing an alkynylamine compound as a grain growth modifier. Specifically, the present invention provides a process of preparing a photographic emulsion comprising:

introducing silver ions, halide ions and a grain growth modifier having the structure wherein z represents atoms necessary to complete a five to nine-membered heterocyclic ring system, $R^1$, $R^2$ and $R^3$ independently represent hydrogen or a lower alkyl of from 1 to 5 carbon atoms, and $R^4$ represents hydrogen, or an aliphatic, carbocyclic, or heterocyclic group, which may be substituted or unsubstituted, into a dispersing medium containing silver halide seed grains; and maintaining the dispersing medium containing the seed grains, silver ions, halide ions and grain growth modifier at a pH in the range from about 4.5 to about 10, and a pAg in the range from about 6.0 to about 9.5.

Also disclosed is a photographic element comprising a support having incorporated thereon a silver halide emulsion layer, the silver halide emulsion layer comprising silver halide grains internally containing a compound of the structure wherein Z represents atoms necessary to complete a five to nine-membered heterocyclic ring system; $R^1$, $R^2$ and $R^3$ independently represent hydrogen or a lower alkyl of from 1 to 5 carbon atoms, with the proviso that at least one of $R^1$, $R^2$ and $R^3$ be a lower alkyl of from 1 to 5 carbon atoms; and $R^4$ represents hydrogen, or an aliphatic, carbocyclic, or heterocyclic group, which may be substituted or unsubstituted.

12 Claims, 8 Drawing Sheets

1 μm

U.S. PATENT DOCUMENTS

| | | | |
|---|---|---|---|
| 4,724,200 | 2/1988 | Maskasky | 430/567 |
| 4,818,674 | 4/1989 | Ogawa | 430/567 |
| 5,389,510 | 2/1995 | Preddy et al. | 430/567 |
| 5,399,479 | 3/1995 | Lok | 430/567 |
| 5,411,854 | 5/1995 | Brust et al. | 430/614 |
| 5,413,905 | 5/1995 | Lok et al. | 430/569 |

1 μm

1 μm

1 μm

1 μm

1 μm

PROCESS OF FORMING A PHOTOGRAPHIC EMULSION

FIELD OF THE INVENTION

This invention relates to a process of forming silver halide emulsions. It also relates to photographic elements useful in photography.

Background of the Invention

In the conventional practice of photography, colloidal emulsions containing silver halide grains are exposed to actinic radiation and then developed in the presence of a reducing agent (developer). In black and white photography, a visible image is formed by the silver metal that results from development. In color photography, a visible image is formed by reaction of a dye precursor with oxidized developer.

The silver halide grains utilized in photographic emulsions are typically formed by precipitation from soluble silver and halide salts. Growth of these grains may be controlled by any one or combination of factors or compounds and can result in grains varying in size, halide composition, and morphology. Morphology is typically used to designate the overall shape of a silver halide grain. For instance, it is known from Maskasky, "The Seven Different Kinds of Crystal Forms of Photographic Silver Halides", Journal of Imaging Science, Vol. 30, 1986, pp. 247–255, that for cubic lattice type silver halide grains, which encompass virtually all types of grains utilized in modern photography, seven naturally occurring morphologies exist: cube, octahedron, rhombic dodecahedron, trisoctahedron, icositetrahedron, tetrahedron, tetradecahedron, and hexaoctahedron. Other morphologies, such as tabular grains and grains having epitaxies (deposits of silver halide on a host grain wherein the deposit is of a different halide composition than the host) are also known.

It is known to control the size of silver halide grains by prolonging precipitation or ripening, or by controlling silver halide growth rates. It is known to control the halide composition of certain grains by controlling the temperature and pressure at which such grains are precipitated. Such is exemplified in James, The Theory of the Photographic Process, 4th Ed, McMillan, New York, 1977 chapter 3.

Control of the morphology of silver halide grains can be accomplished through controlling pAg in the precipitation solution, as in James, pp 98–100 or by precipitation in the presence of organic compounds known as grain growth modifiers. Grain growth modifiers are believed to affect the rate at which grain growth occurs in specific regions of a precipitating grain. It is thought that they preferentially adsorb to a particular type of crystal face of a host grain and prevent the continued growth of that type of face while allowing for the continued growth of other types of crystal faces. In this manner, grain growth modifiers allow grains to grow faster in one or several directions while simultaneously halting (or slowing) growth in other directions. The resulting grains typically are of a different morphology than the original host grains.

By crystal face type, it is meant the ionic arrangement on the faces that bound a silver halide grain. Typically, Miller indices are used when describing this ionic arrangement. To illustrate, grains having a cubic morphology have six identical {100} crystal faces, the faces being described with reference to their particular Miller indices. Octahedral grains, by contrast, have eight identical {111} crystal faces, and rhombic dodecahedral grains have twelve identical {110} faces. Other morphologies, as described above, have additional types of crystal faces. They may also have crystal faces that are of the {100}, {110} or {111} type; essentially, each morphology has its own type and combination of crystal faces. Miller indices, calculations thereof, and their manner of application are described in A. Bennet, D. Hamilton, A. Maradudin, R. Miller and J. Murphy, Crystals Perfect and Imperfect, Walker and Company, New York, 1965.

As previously described, control over the morphology of silver halide grains can be accomplished through precipitation in the presence of a grain growth modifier. Known growth modifiers include tetraazaindenes, imadazoles, benzimidazoles, rhodanines, thiacarbocyanines, and formamides, each of which has a propensity for allowing the formation of specific morphologies having specific types of crystal faces. Specific examples of grain growth modifiers and their methods of use are described in Maskasky, U.S. Pat. Nos. 4,680,254; 4,724,200; 4,680,255; 4,680,256; 4,643,966; Nishiyama, U.S. Pat. No. 4,683,192; and Ogawa, U.S. Pat. No. 4,818,674.

The ability of certain alkynylamine compounds to produce increases in speed and latent image-stability when incorporated into photographic emulsions as addenda subsequent to precipitation has been described in Lok U.S. Pat. Nos. 4,378,426 and 4,451,557. While this is known, and while it is known to employ grain growth modifiers during the precipitation of silver halide grains, prior to our invention there was no recognition in the art that certain speed addenda could be utilized as grain growth modifiers to effectuate the formation of silver halide grains having certain morphologies.

Summary of the Invention

Accordingly, the present invention provides a process of preparing a photographic emulsion utilizing an alkynylamine compound as a grain growth modifier. Specifically, the present invention provides a process of preparing a photographic emulsion comprising:

introducing silver ions, halide ions and a grain growth modifier having the structure

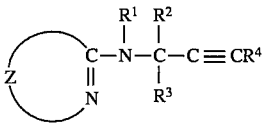

wherein Z represents atoms necessary to complete a five to nine-membered heterocyclic ring system, $R^1$, $R^2$ and $R^3$ independently represent hydrogen or a lower alkyl of from 1 to 5 carbon atoms, and $R^4$ represents hydrogen, or an aliphatic, carbocyclic, or heterocyclic group, which may be substituted or unsubstituted, into a dispersing medium containing silver halide seed grains; and maintaining the dispersing medium containing the seed grains, silver ions, halide ions and grain growth modifier at a pH in the range from about 4.5 to about 10, and a pAg in the range from about 6.0 to about 9.5.

The invention also provides a photographic element comprising a support having incorporated thereon a silver halide emulsion layer, the silver halide emulsion layer comprising silver halide grains internally containing a compound of the structure

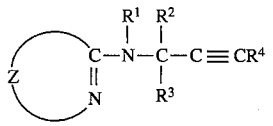

wherein Z represents atoms necessary to complete a five to nine-membered heterocyclic ring system; $R^1$, $R^2$ and $R^3$ independently represent hydrogen or a lower alkyl of from 1 to 5 carbon atoms, with the proviso that at least one of $R^1$, $R^2$ and $R^3$ be a lower alkyl of from 1 to 5 carbon atoms; and $R^4$ represents hydrogen, or an aliphatic, carbocyclic, or heterocyclic group, which may be substituted or unsubstituted.

It was quite unexpected that the alkynylamine compounds of the present invention could impact grain growth during precipitation. The present invention thus provides a practical and attractive process for the preparation of a whole range of photographic emulsion types. In addition, as the alkynylamines retain their speed and stability improving characteristics, the present invention provides processes for forming photographic emulsions that exhibit greater speed and sensitivity.

DETAILED DESCRIPTION OF THE INVENTION

Figure 1:
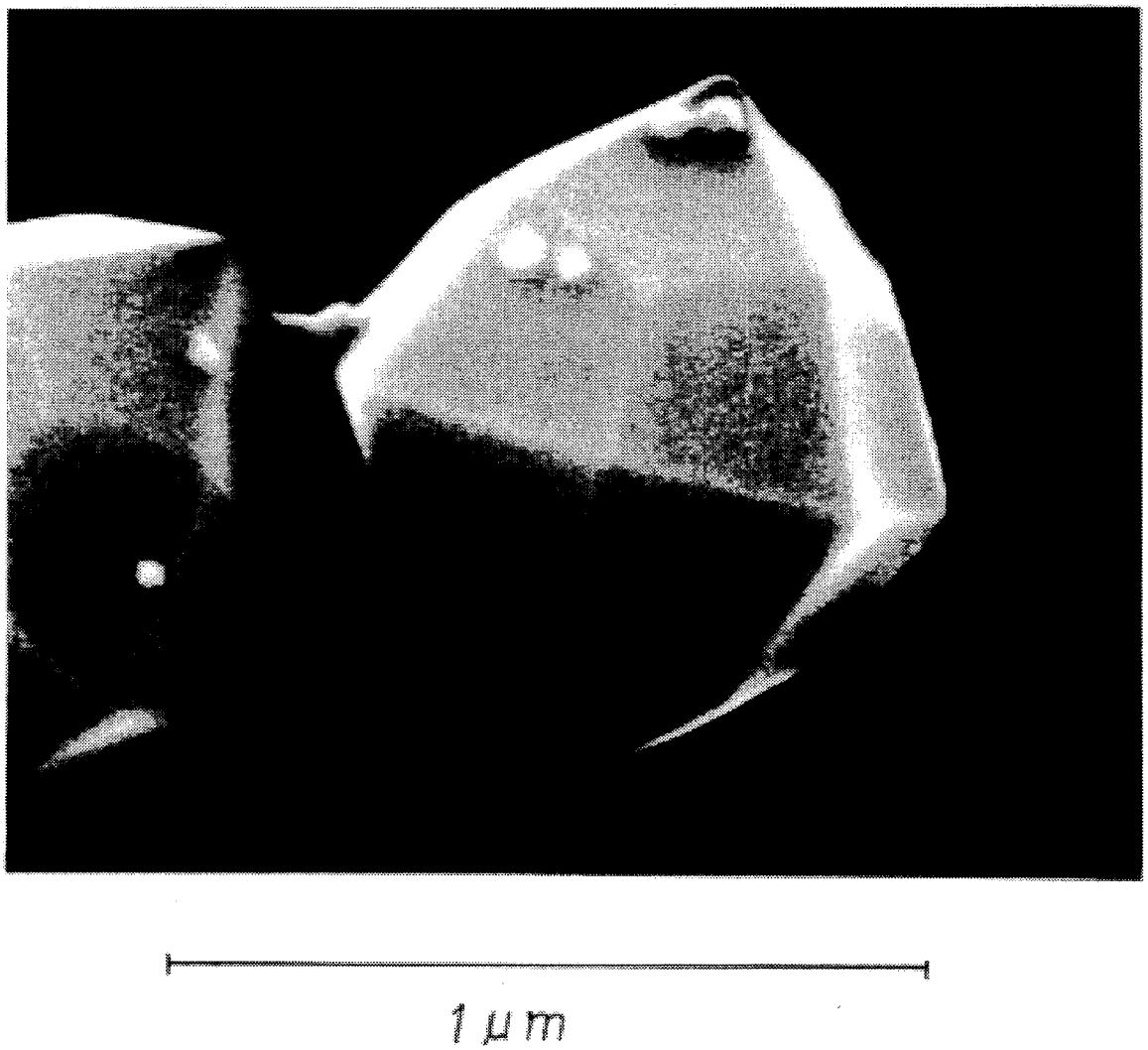
FIG. 1 is a scanning electron micrograph of the grains formed by a preferred embodiment of the invention, Example 1. The grains are icositetrahedral in morphology.

The present invention relates to an improved process of preparing a photographic emulsion wherein the process utilizes as a grain growth modifier a compound whose photographic properties were previously thought to consist of only sensitivity and stability improving properties. The grain growth modifiers utilized in the present invention are alkynylamine compounds. Specifically, they are of the structure:

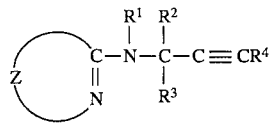

Formula 1 wherein Z represents atoms necessary to complete a five to nine-membered heterocyclic ring system, preferably a five or nine membered heterocyclic ring system; $R^1$, $R^2$ and $R^3$ independently represent hydrogen or a lower alkyl of from 1 to 5 carbon atoms; and $R^4$ represents hydrogen, or an aliphatic, carbocyclic (includes aryl), or heterocyclic (includes heteroaryl) group, which may be substituted or unsubstituted.

The process employing these alkynylamine compounds as grain growth modifiers in the preparation of photographic emulsions includes introducing silver ions, halide ions, and a grain growth modifier according to Formula 1 into a dispersing medium containing silver halide seed grains; and then maintaining the dispersing medium containing the seed grains, silver ions, halide ions and grain growth modifier at a pH in the range from about 4.5 to about 10, a pAg in the range from about 6.0 to about 9.5, and for a sufficient period of time so as to allow precipitation onto the seed grains in an amount sufficient to change the morphology of the seed grains.

In accordance with the preferred embodiments of the present invention, the grain growth modifier has the structure:

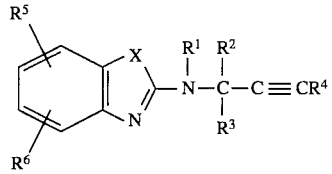

Formula 2 wherein X represents oxygen, sulfur, or selenium, or a substituted or unsubstituted nitrogen; $R^1$, $R^2$ and $R^3$ independently represent hydrogen or a lower alkyl of from 1 to 5 carbon atoms, and $R^4$ represents hydrogen, or an aliphatic, carbocyclic, or heterocyclic group, which may be substituted or unsubstituted; and $R^5$ and $R^6$ independently represent hydrogen, a halogen, or a substituted or unsubstituted alkyl or alkoxy group. Preferably, $R^4$ is other than hydrogen. More preferably, it is an alkyl of from 1 to 20 carbon atoms. And optimally, it is a methyl group. In the alkynylamines described by Formula 2 above, $R^5$ and $R^6$ are preferably in the 6 and 5 positions, respectively.

In the structures described above, that is the structures described by both Formula 1 and Formula 2, suitable aliphatic groups include methyl, ethyl, propyl, butyl, pentyl, hexyl, octyl, decyl, dodecyl, hexadecyl, octadecyl, isopropyl, t-butyl, butenyl, propynyl, and butynyl. Suitable carbocyclic groups include phenyl, tolyl, naphthyl, cyclohexyl, cycloheptatrienyl, cyclooctatrienyl, cyclononatrienyl, p-methoxyphenyl, and p-chlorophenyl. And suitable heterocyclic groups and ring systems (by heterocyclic ring systems, it is meant a single heterocyclic ring, or multiple fused rings in which at least one of the rings is a heterocycle) include pyrrole, furan, tetrahydrofuran, pyridine, picoline, piperidine, morpholine, pyrrolidine, thiophene, oxazole, thiazole, imidazole, selenazole, tellurazole, triazole, tetrazole, oxadiazole, benzoxazole, benzothiazole, benzoselenazole, pyrimidine, quinoline, and benzimidazole.

Both the heterocyclic group, as in $R^4$, and the heterocyclic ring system, as in Z, can be substituted or unsubstituted.

Groups suitable for substitution on these groups, as well as on aliphatic, carbocyclic or other groups described above, include alkyl groups (for example, methyl, ethyl, hexyl), fluoroalkyl groups (for example, trifluoromethyl), alkoxy groups (for example, methoxy, ethoxy, octyloxy), aryl groups (for example, phenyl, naphthyl, tolyl), halogen groups, aryloxy groups (for example, phenoxy), alkylthio groups (for example, methylthio, butylthio), arylthio groups (for example, phenylthio), acyl groups (for example, acetyl, propionyl, butyryl, valeryl), sulfonyl groups, acylamino groups, sulfonylamino groups, cyano groups and acyloxy groups (for example, acetoxy, benzoxy).

Specific compounds contemplated to be within the scope of the present invention include:

Compound A:

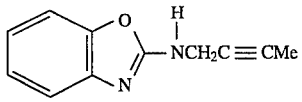

Compound B:

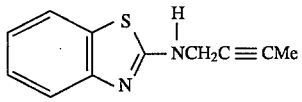

Compound C:

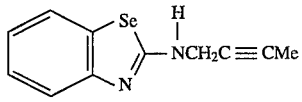

Compound D:

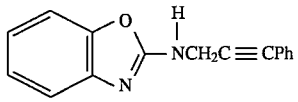

Compound E:

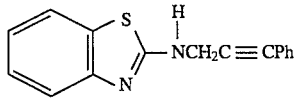

Compound F:

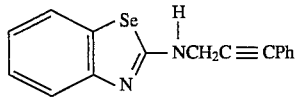

Compound G:

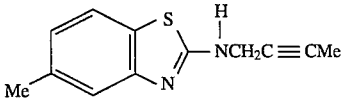

Compound H:

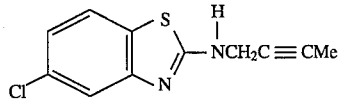

-continued

Compound I:

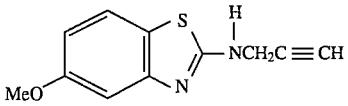

Compound J:

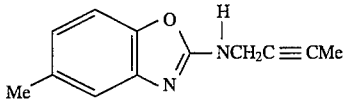

Compound K:

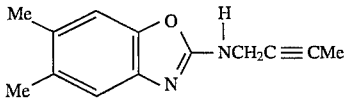

Compound L:

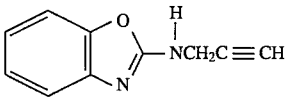

Compound M:

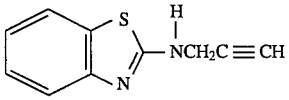

Compound N:

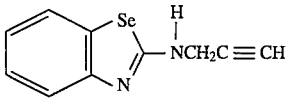

Compound O:

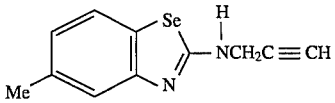

Compound P:

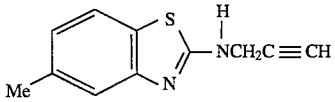

Compound Q:

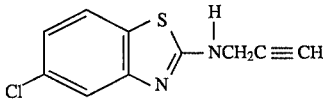

Compound R:

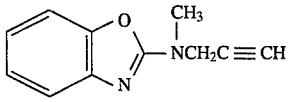

-continued

Compound S:

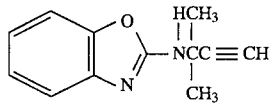

and

Compound T:

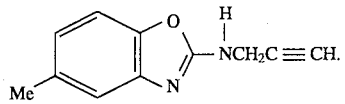

In the process of the present invention the amount of grain growth modifier required to control growth of the grain population is contemplated to be an amount necessary to provide a monomolecular adsorbed layer over at least 25 percent, preferably at least 50 percent, and more preferably at least 75 percent of the total grain surface area of the emulsion grains. Higher amounts of adsorbed growth modifier are also feasible, with growth modifier coverage of 80 percent of the monomolecular coverage or even 100 percent coverage specifically contemplated. Excess growth modifier is also contemplated as any growth modifier that remains unabsorbed is normally depleted in post-precipitation emulsion washing.

With respect to specific levels of growth modifier relative to the molar amount of silver halide, the present invention prefers that the levels be from about 0.1 to about 100 millimoles per total mole of silver halide. More preferably, the levels are from about 0.5 to 50 millimoles per total mole of silver halide. And optimally, the levels are from 1.0 to 10 millimoles per total mole silver halide. Use of such preferred and optimal levels is sufficient to accomplish adequate grain growth modification while not significantly, and deleteriously, impacting the resulting emulsions' sensitivity and fog positions.

The grain growth modifier can be added to the dispersing medium by any conventional method known in the art. It can be added initially at the start of precipitation or it can be added incrementally as the total surface area of the grains in the emulsion increases. The grain growth modifier can further be added along with the introduction of silver and halide ions or it can be added at a different time. As long as precipitation occurs in the presence of the modifier, its intended effects will be demonstrated.

The grain growth modifiers utilized in the present invention enable the formation of multiple types of crystal faces. Compounds A and R, for example, surprisingly were found to modify growth in such a manner that {h11} crystal faces, which are generally referred to as icositetrahedral faces, formed. h is a whole integer greater than 1; typically it is 2 or 3. Its specific value can be confirmed by a combination of visual inspection and the determination of the angle formed by the intersection of adjacent crystalline faces.

Grains formed according to the present invention wherein the grain growth modifier was selected from these compounds and was introduced into a dispersing medium containing silver ions, bromide and/or iodide ions, and cubic seed grains comprised of silver bromide or silver iodobromide, were icositetrahedral in morphology. Formation of such grains was, of course, dependent on there being a sufficient period of time in which precipitation occurred, and a sufficient amount of silver and halide ions with which to form the icositetrahedral grains.

By contrast, when compounds L and S were utilized as in the above described process, octahedral grains having {111} crystal faces formed. In this regard, it was surprising to find that different compounds within the family of grain growth modifiers employed in the present invention tended to allow formation of different types of crystal faces.

In the present invention, preparation of the photographic emulsion should occur under conditions in which pH is maintained in the range of from about 4.5 to about 10, although it is preferred that pH be in the range of from about 5 to about 9. Even more preferred, the preparation occurs under conditions in which pH is maintained in the range of from about 5 to about 8.

Any convenient conventional approach of adjusting and maintaining pH in the desired range can be employed. For example, strong mineral acids, such as nitric acid or sulfuric acids, or strong mineral bases such as an alkali hydroxide can be added to the dispersing medium. Monitoring and maintaining replicable pH profiles during repeated precipitations can be accomplished by additions of pH buffers to the dispersing medium. Exemplary useful buffers include sodium or potassium acetate, phosphate, oxalate and pthalate, as well as tris(hydroxymethyl)aminomethane.

Preparation of the photographic emulsions according to the present invention's process should also occur under conditions in which pAg is maintained in the range of from about 6.0 to about 9.5, with a range of from about 6.0 to about 9.0 being even more preferred. Optimally, pAg is maintained in the range of from about 6.5 to about 9.0. Any convenient conventional approach of adjusting and maintaining pAg in the desired range can be employed. For example pAg can be varied by the addition of solutions containing halide and/or silver ions.

Introduction of silver ions and halide ions in the present process can likewise be by conventional means. Contemplated is the introduction through single jet or double jet precipitation equipment. Also contemplated is the introduction of silver and halide ions via digestion of fine silver halide grains already pre-existing in the dispersing medium. That is, fine silver halide grains present in the dispersing medium can disassociate to form silver and halide ions, which are soluble in the aqueous environment of the dispersing medium. These ions, in turn, can reprecipitate (ripen) onto the seed grains in the presence of the grain growth modifier.

It is desired that during precipitation of the silver halide emulsion, there is present a stoichiometric excess of halide ion. This avoids the possibility of excess silver ion being reduced to metallic silver and resulting in photographic fog.

Generally, the present invention may be practiced with any combination of halide ion types or silver halide seed grains. The halide ions and the halide of the seed grains may be composed of bromide, chloride and iodide in any proportion which would allow formation of cubic crystal lattices (extremely high levels of iodide in the resulting grains would likely be impractical as such grains form what is known in the art as a wurtzite crystal lattice). Ultimately, the silver halide grains prepared during the practice of the present invention can be comprised of silver bromide, silver chloride, silver iodide, silver iodobromide, silver chlorobromide, silver iodochloride, silver iodochlorobromide and silver iodobromochloride. Preferably, though, both the halide ions added during precipitation and the halide of the seed grains are predominantly bromide and iodide. In this manner, predominantly silver bromide or silver iodobromide grains are formed. By predominantly silver bromide or silver iodobromide, it is meant that such grains (or such halide ions as the case may be) are greater than about 50 molar percent of the indicated silver halide. Preferably, the indicated silver halide accounts for greater than about 85 molar percent, and more preferably about 99 to 100 percent.

The silver halide seed grains employed in the present invention may be any size and have any conventional morphology. Thus, they may take the form of cubes, octahedrons, cubo-octahedrons, or any of the other naturally occurring morphologies of cubic lattice type silver halide grains. Further, the seed grains may be irregular such as spherical grains or tabular grains.

Because the growth modifiers of the present invention are selective in the type of crystal face that they facilitate, it is necessary that the seed grains comprise crystal faces that are compatible with the particular grain growth modifier used. In other words, grain growth modifiers that facilitate formation of {111} crystal faces, for example compounds L and S, would not modify the crystal growth of octahedral grains which inherently already have eight {111} crystal faces. By contrast, these same grain growth modifiers would be capable of modifying seed grains having non-{111} crystal faces, such as the {100} crystal faces of a cubic grain. To further illustrate, Compound S, as illustrated below in Example 3, facilitates formation of {111} crystal faces. Use of this grain growth modifier with seed grains having only {111} crystal faces results in an enlargement of the seed grain but not a change in morphology (see Example 4). Use of this grain growth modifies with seed grains having other than {111} crystal faces, by contrast, results in adequate grain growth modification during precipitation (see Example 3).

In a preferred embodiment of the invention, the silver halide seed grains are bounded by at least two {100} crystal faces. Further, it is preferred that the seed grains have a cubic or tabular morphology, with a cubic morphology being even more preferred; and that they be modified (i.e. precipitated upon for a sufficient length of time—determined with reference to flow rates and the amount of silver and halide ions in the dispersing medium—and in the presence of a sufficient amount of silver and halide ions, and grain growth modifier) in such a manner that icositetrahedral, octahedral, or cubo-octahedral grains are formed. It is preferred that the molar amount of silver halide growth be at least 50% by weight, that of the seed grains of the silver halide emulsion.

The dispersing medium utilized in the present invention can be any conventional dispersing medium capable of being used in photographic emulsions. Specifically, it is contemplated that the dispersing medium be an aqueous gelatino-peptizer dispersing medium, of which gelatin—e.g., alkali treated gelatin (cattle bone and hide gelatin) or acid treated gelatin (pigskin gelatin) and gelating derivatives—e.g., acetylated gelatin, pthalated gelatin and the like are specifically contemplated. When used, gelatin is preferably of levels of 0.01 to 100 grams per total silver mole. Also contemplated are dispersing mediums comprised of synthetic colloids, such as those described in *Research Disclosure,* December 1989, Item 308119, Section IX, paragraph B.

Photographic emulsions prepared by practice of the present invention may be incorporated into black-and-white, reversal, color negative or paper photographic elements utilizing other layer containing any other type of silver halide grains. These other grains may be conventional in form such as cubic, octahedral, or cubo-octahedral, or they may be irregular such as spherical grains or tabular grains.

The photographic elements may be simple single layer elements or multilayer, multicolor elements. Multicolor elements contain dye image-forming units sensitive to each of the three primary regions of the visible light spectrum. Each unit can be comprised of a single emulsion layer or of multiple emulsion layers sensitive to a given region of the spectrum. The layers of the element, including the layers of the image-forming units, can be arranged in various orders as known in the art.

A typical multicolor photographic element comprises a support bearing a cyan dye image-forming unit comprising at least one red-sensitive silver halide emulsion layer having associated therewith at least one cyan dye-forming coupler; a magenta image-forming unit comprising at least one green-sensitive silver halide emulsion layer having associated therewith at least one magenta dye-forming coupler; and a yellow dye image-forming unit comprising at least one blue-sensitive silver halide emulsion layer having associated therewith at least one yellow dye-forming coupler. The element may contain additional layers, such as filter layers, interlayers, overcoat layers, subbing layers, and the like.

The photographic elements may also contain a transparent magnetic recording layer such as a layer containing magnetic particles on the underside of a transparent support, as in U.S. Pat. Nos. 4,279,945 and 4,302,523. Typically, the element will have a total thickness (excluding the support) of from about 5 to about 30 microns.

In the following discussion of suitable materials for use in the elements of this invention, reference will be made to *Research Disclosure,* December 1978, Item 17643, and *Research Disclosure,* December 1989, Item 308119, both published by Kenneth Mason Publications, Ltd., Dudley Annex, 12a North Street, Emsworth, Hampshire PO10 7DQ, ENGLAND, the disclosures of which are incorporated herein by reference. These publications will be identified hereafter by the term "Research Disclosure." A reference to a particular section in "Research Disclosure" corresponds to the appropriate section in each of the above-identified *Research Disclosures.* The elements of the invention can comprise emulsions and addenda described in these publications and publications referenced in these publications.

The silver halide emulsions employed in photographic elements can also include other silver halide grains. Such grains can be comprised of silver bromide, silver chloride, silver iodide, silver bromochloride, silver iodochloride, silver iodobromide, silver iodobromochloride or mixtures thereof. The emulsions can include silver halide grains of any conventional shape or size. Specifically, the emulsions can include course, medium or fine silver halide grains. High aspect ration tabular grain emulsions are specifically contemplated, such as those disclosed by Wilgus et al. U.S. Pat. No. 4,434,226, Daubendiek et al. U.S. Pat. No. 4,414,310, Wey U.S. Pat. No. 4,399,215, Solberg et al. U.S. Pat. No. 4,433,048, Mignot U.S. Pat. No. 4,386,156, Evans et al. U.S. Pat. No. 4,504,570, Maskasky U.S. Pat. No. 4,400,463, Wey et al. U.S. Pat. No. 4,414,306, Maskasky U.S. Pat. Nos. 4,435,501 and 4,643,966 and Daubendiek et al. U.S. Pat. Nos. 4,672,027 and 4,693,964, all of which are incorporated herein by reference. Also specifically contemplated are those silver iodobromide grains with a higher molar proportion of iodide in the core of the grain than in the periphery of the grain, such as those described in British Reference No. 1,027,146; Japanese Reference No. 54/48,521; U.S. Pat. Nos. 4,379,837; 4,444,877; 4,665,012; 4,686,178; 4,565,778; 4,728,602; 4,668,614 and 4,636,461; and in European Reference No 264,954, all of which are incorporated herein by reference.

The silver halide emulsions can be either monodisperse or polydisperse as precipitated. The grain size distribution of the emulsions can be controlled by silver halide grain separation techniques or by blending silver halide emulsions of differing grain sizes.

Dopants, such as compounds of copper, thallium, lead, bismuth, cadmium and Group VIII noble metals, can be present during process of the present invention or during preparation of silver halide grains employed in other emulsion layers of the photographic element. Other dopants include transition metal complexes as described in U.S. Pat. Nos. 4,981,781, 4,937,180, and 4,933,272.

The emulsions prepared by the present invention can be surface-sensitive emulsions, i.e., emulsions that form latent images primarily on the surface of the silver halide grains; or internal latent image-forming emulsions, i.e., emulsions that form latent images predominantly in the interior of the silver halide grains. The emulsions can be negative-working emulsions such as surface-sensitive emulsions or unfogged internal latent image-forming emulsions, but can also be direct-positive emulsions of the unfogged, internal latent image-forming type, which are positive-working when development is conducted with uniform light exposure or in the presence of a nucleating agent.

The modified and seed grains of silver halide emulsions can further be surface-sensitized, and noble metal (e.g., gold), middle chalcogen (e.g., sulfur, selenium, or tellurium) and reduction sensitizers, employed individually or in combination, are specifically contemplated. Typical chemical sensitizers are listed in *Research Disclosure,* Item 308119, cited above, Section III.

The silver halide emulsions can be spectrally sensitized with dyes from a variety of classes, including the polymethine dye class, which includes the cyanines, merocyanines, complex cyanines and merocyanines (i.e., tri-tetra-, and polynuclear cyanines and merocyanines), oxonols, hemioxonols, stryryls, merostyryls, and streptocyanines. Illustrative spectral sensitizing dyes are disclosed in *Research Disclosure,* Item 308119, cited above, Section IV.

Suitable vehicles for the emulsion layer and other layers of elements of this invention are described in *Research Disclosure,* Item 308119, Section IX and the publications cited therein.

The photographic elements can include couplers as described in *Research Disclosure,* Section VII, paragraphs D, E, F, and G and the publications cited therein. The couplers can be incorporated as described in *Research Disclosure,* Section VII, paragraph C, and the publications cited therein. Also contemplated are elements which further include image modifying couplers as described in *Research Disclosure,* Item 308119, Section VII, paragraph F.

The photographic elements can contain brighteners (*Research Disclosure,* Section V), antifoggants and stabilizers such as mercaptoazoles (for example, 1-(3-ureidophenyl)-5-mercaptotetrazole), azolium salts (for example, 3-methylbenzothiazolium tetrafluoroborate), thiosulfonate salts (for example, p-toluene thiosulfonate potassium salt), tetraazaindenes (for example, 4-hydroxy-6-methyl- 1,3,3a, 7-tetraazaindene), and those described in *Research Disclosure,* Section VI, anti stain agents and image dye stabilizers (*Research Disclosure,* Section VII, paragraphs I and J), light absorbing and scattering materials (*Research Disclosure,* Section VIII), hardeners (*Research Disclosure,* Section X), polyalkyleneoxide and other surfactants as described in U.S. Pat. No. 5,236,817, coating aids (*Research Disclosure,* Section XI), plasticizers and lubricants (*Research Disclosure,* Section XII), anti static agents (*Research Disclosure,* Section XIII), matting agents (*Research Disclosure,* Section XII and XVI) and development modifiers (*Research Disclosure,* Section XXI.

The photographic emulsions can be coated on a variety of supports as described in *Research Disclosure,* Section XVII and the references described therein.

The photographic elements can be exposed with various forms of energy which encompass the ultraviolet, visible, and infrared regions of the electromagnetic spectrum as well as with electron beam, beta radiation, gamma radiation, x-ray, alpha particle, neutron radiation, and other forms of corpuscular and wave-like radiant energy in either noncoherent (random phase) forms or coherent (in phase) forms, as produced by lasers. When the photographic elements are intended to be exposed by x-rays, they can include features found in conventional radiographic elements, such as those disclosed in *Research Disclosure,* Vol. 184, August 1979, Item 18431 which is incorporated herein by reference.

The photographic elements are preferably exposed to actinic radiation, typically in the visible region of the spectrum, to form a latent image as described in *Research Disclosure,* Section XVIII, and then processed to form a visible dye image as described in *Research Disclosure,* Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents are p-phenylenediamines. Especially preferred are 4-amino-3 -methyl-N,N-diethylaniline hydrochloride, 4-amino-3 -methyl-N-ethyl-N-(β-methanesulfonamidoethyl)-aniline sulfate hydrate, 4-amino-3-methyl-N-ethyl-N-(β -hydroxyethyl)-aniline sulfate, 4-amino-3-(β -methanesulfonamidoethyl)-N,N-diethylaniline hydrochloride, and 4-amino-N-ethyl-N-(β-methoxyethyl)-m-toluidine di-p-toluenesulfonic acid.

With negative-working silver halide emulsions, the processing step described above provides a negative image. The described elements can be processed in the known C-41 color process as described in, for example, the British Journal of Photography Annual, 1988, pages 196–198. To provide a positive (or reversal) image, the color development step can be preceded by development with a nonchromogenic developing agent to develop exposed silver halide, but not form dye, and then uniformly fogging the element to render unexposed silver halide developable. Reversal processing of the element of the invention is preferably done in accordance with the known E6 process as described and referenced in *Research Disclosure* Section XIX. Alternatively, a direct positive emulsion can be employed to obtain a positive image.

Development is followed by the conventional steps of bleaching, fixing, or bleach-fixing, to remove silver or silver halide, washing, and drying.

The present invention is also directed to novel photographic elements comprising a support having incorporated thereon a silver halide emulsion layer, the silver halide emulsion layer comprising silver halide grains internally containing a compound of the formula

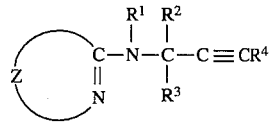

wherein Z represents atoms necessary to complete a five to nine-membered heterocyclic ring system; $R^1$, $R^2$ and $R^3$ independently represent hydrogen or a lower alkyl of from 1 to 5 carbon atoms, with the proviso that at least one of $R^1$, $R^2$ and $R^3$ be a lower alkyl of from 1 to 5 carbon atoms; and $R^4$ represents hydrogen, or an aliphatic, carbocyclic, or heterocyclic group, which may be substituted or unsubstituted.

Preferred compounds and photographic elements in accordance with this embodiment of the invention are as described above with reference to the preferred process of the invention. Thus, they can be black-and-white, reversal, color negative or paper photographic elements utilizing a single layer or multilayer, multicolor structure. Further, they can contain dopants, chemical or spectral sensitizers, image-forming couplers, antifoggants, stabilizers, anti stain agents, light absorbing and scattering materials, hardeners, coating aids, plasticizers, lubricants, anti static agents, matting agents, and development modifiers; and they can be coated on a variety of supports.

The photographic elements can be exposed with various forms of energy, preferably actinic radiation in the visible spectrum, and then processed to form a visible image.

The invention can be better appreciated by reference to the following specific examples. They are intended to be illustrative and not exhaustive of the process and elements of the present invention.

EXAMPLES

A silver bromide cubic seed emulsion with 0.76-μm edge length was precipitated at pAg 5.8, pH 6.0, and 70° C. in oxidized gelatin. Four-tenths of a silver mole of the seed emulsion was added to a reaction vessel mounted with a motor-driven mixer. Five grams of oxidized gelatin were then added followed by distilled water to give a final weight of 450 g. A control precipitation was made in the absence of the compounds of the present invention by adding to the cubic seed emulsion 0.5 mole of 2.5M $AgNO_3$ and 2.5M NaBr solutions and maintaining the emulsion at a pH of 6.5, a pAg of 6.7 and a temperature of 60° C. Scanning Electron Microscope (SEM) examination showed that the cubic morphology was maintained throughout the control precipitation, and that the grains merely increased in size.

The growth-modifying effects of the alkynylamines were then examined by utilizing the same precipitation conditions as the control precipitation. pH and pAg in the reaction vessel containing the cubic seed emulsion were first adjusted to 6.5 and 6.7, respectively. A total of 1 mmole of the below indicated alkynylamines was slowly added to the cubic seed emulsion in the reaction vessel. The emulsion pH and pAg were readjusted back to the control values, and then maintained throughout precipitation. Samples were drawn out of the emulsion after approximately a quarter of the precipitation had occurred (20–30 minutes) and examined by scanning electron microscope for morphology changes caused by growth in the presence of the alkynylamine.

Example 1

As can be seen in FIG. 1, this example illustrates the formation of icositetrahedral silver bromide emulsions using a cubic silver bromide seed emulsion and Compound R.

Example 2

Figure 2:
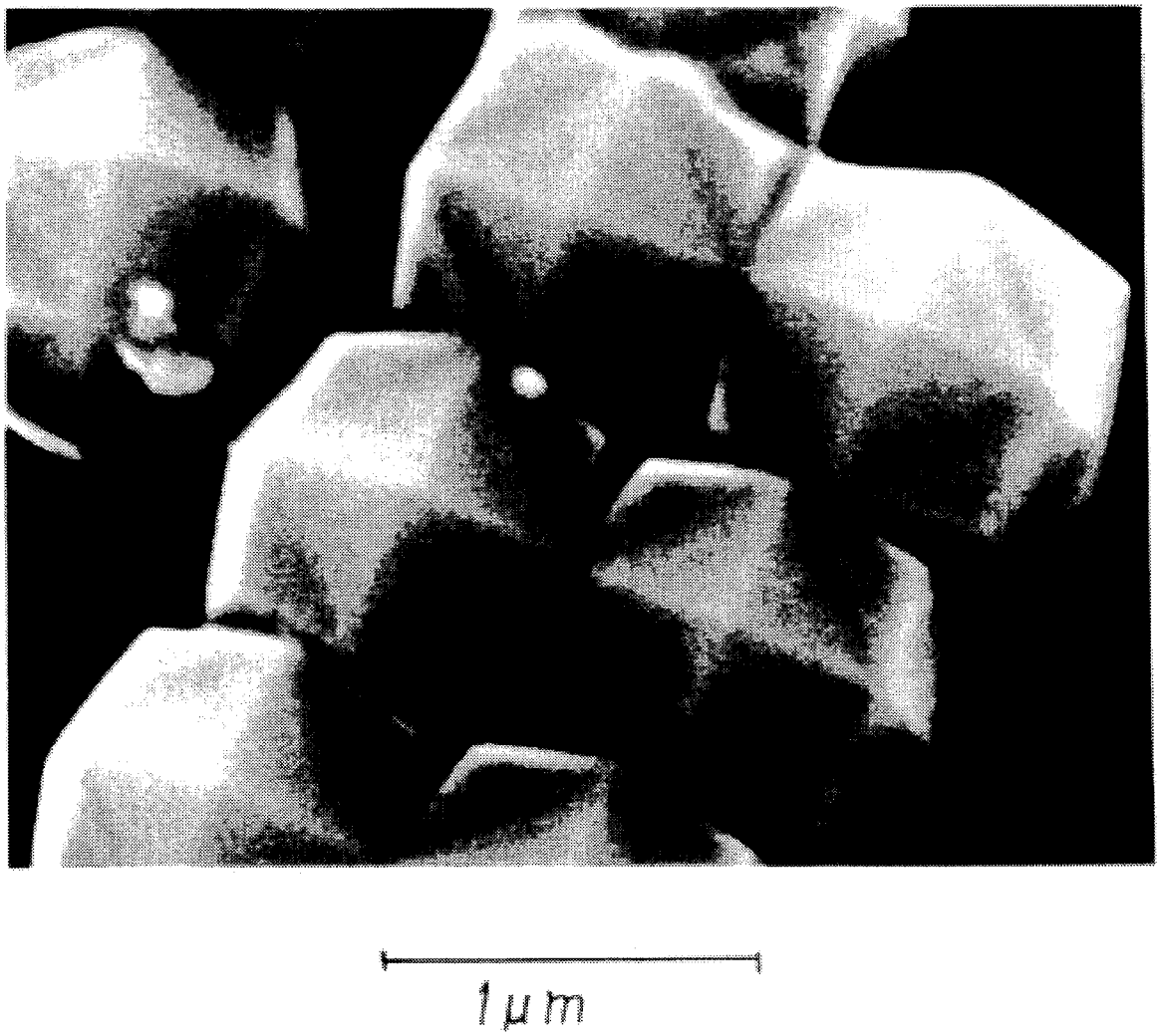
FIG. 2 is a scanning electron micrograph of the grains formed by another preferred embodiment of the invention, Example 2. Four icositetrahedral faces are shown forming on each face of cubic silver bromide seed grains.

As can be seen in FIG. 2, this example illustrates the formation of silver bromide emulsions comprising grains whose morphology is becoming that of an icositetrahedron. Four icositetrahedral faces are seen forming on each of the cubic faces of the cubic seed grains. Compound A was utilized as the grain growth modifier.

Example 3

Figure 3:
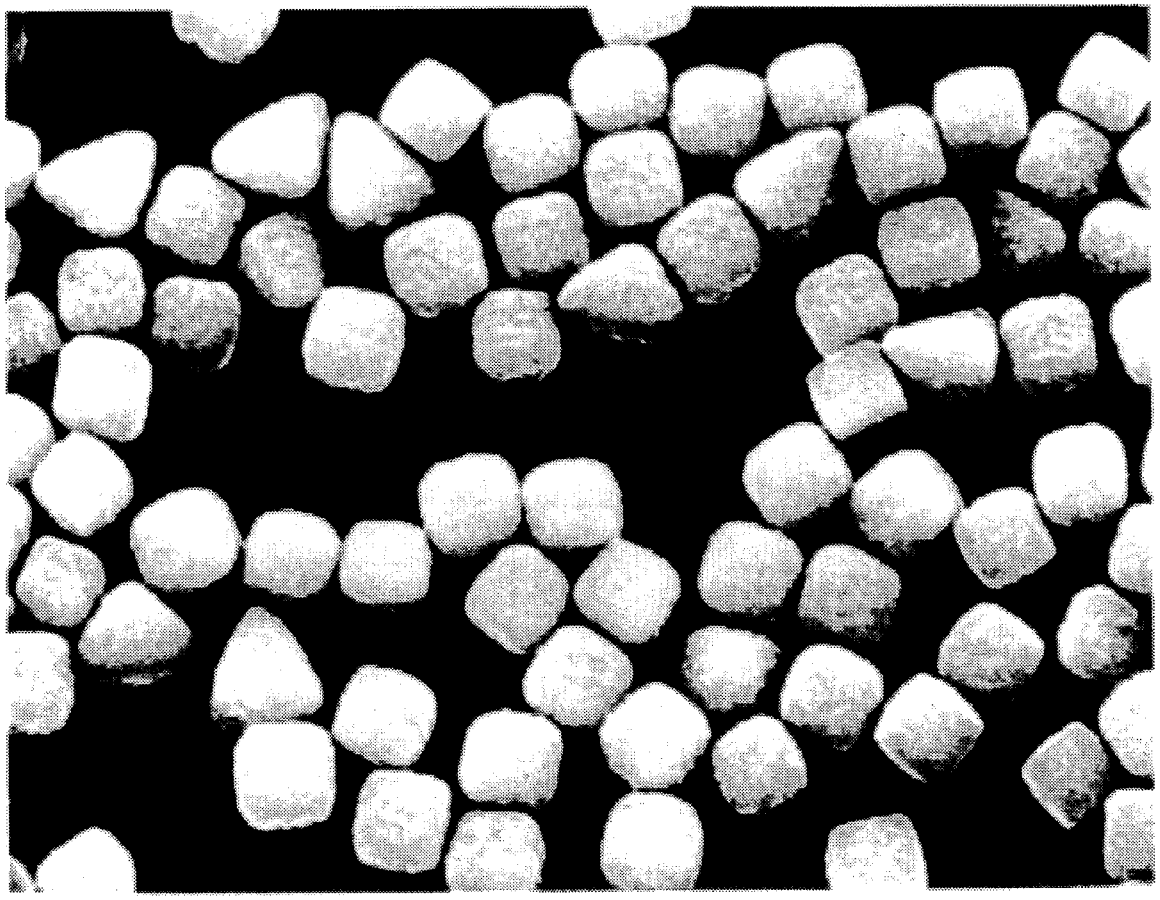
FIGS. 3 and 4 are scanning electron micrographs of the grains formed by a third preferred embodiment of the invention, Example 3. The grains of FIG. 3 are cubic in morphology with ruffle surfaces. The grains of FIG. 4 are octahedral in morphology.
Figure 4:
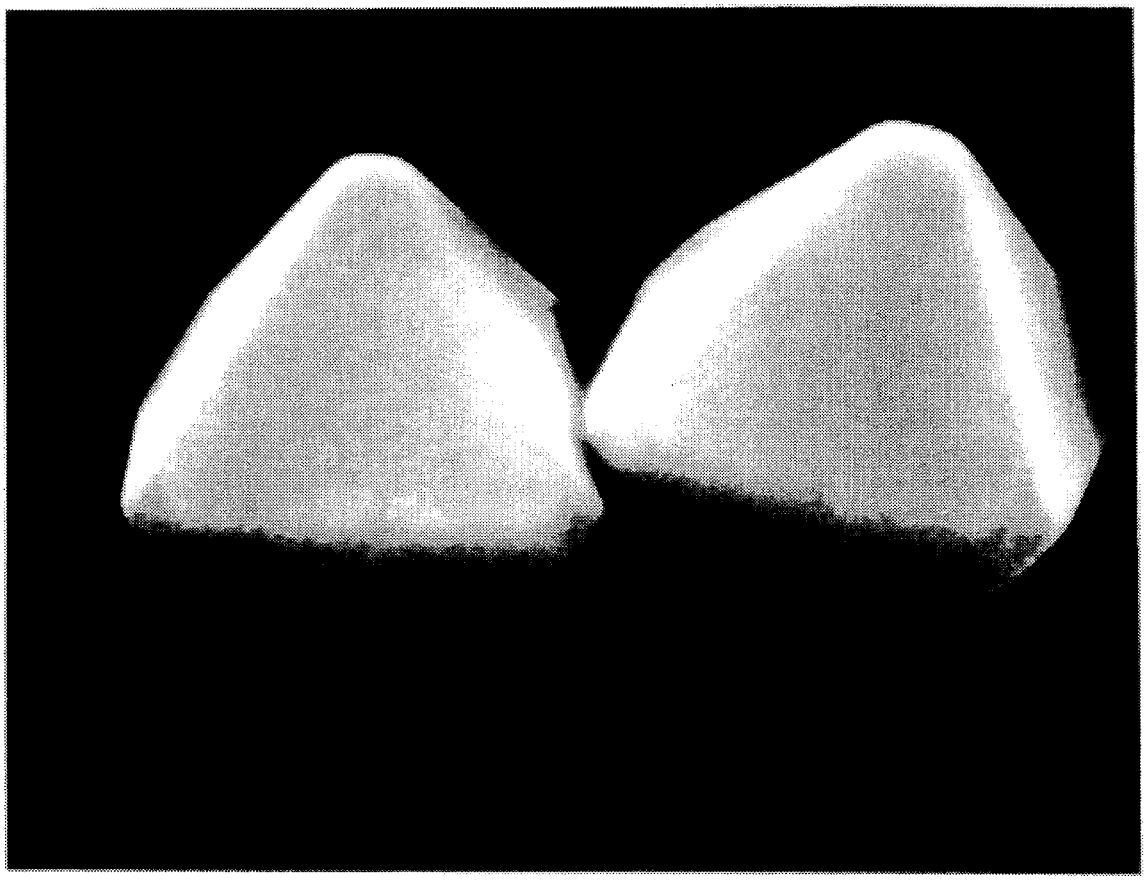

In this example, emulsion samples were drawn out and examined soon after precipitation in the presence of Compound S had begun. The result, as seen in FIG. 3, is the formation of ruffled surfaces on the emulsion seed grains. After precipitation was complete, emulsion samples were again drawn out and examined. The result, as seen in FIG. 4, is the formation of octahedral grains having eight {111} crystal faces.

Example 4

Unlike the previous examples, this comparative example utilized tabular {111} seed emulsions having an average equivalent circular diameter of 2.7 microns and an average thickness of 0.12 microns, in the presence of 0.25 moles of 2.5M $AgNO_3$ and 2.5M NaBr solutions, and 1 mmole of Compound S. pH was maintained at 6.5, pAg at 8.9, and temperature at 60° C.

Figure 5:
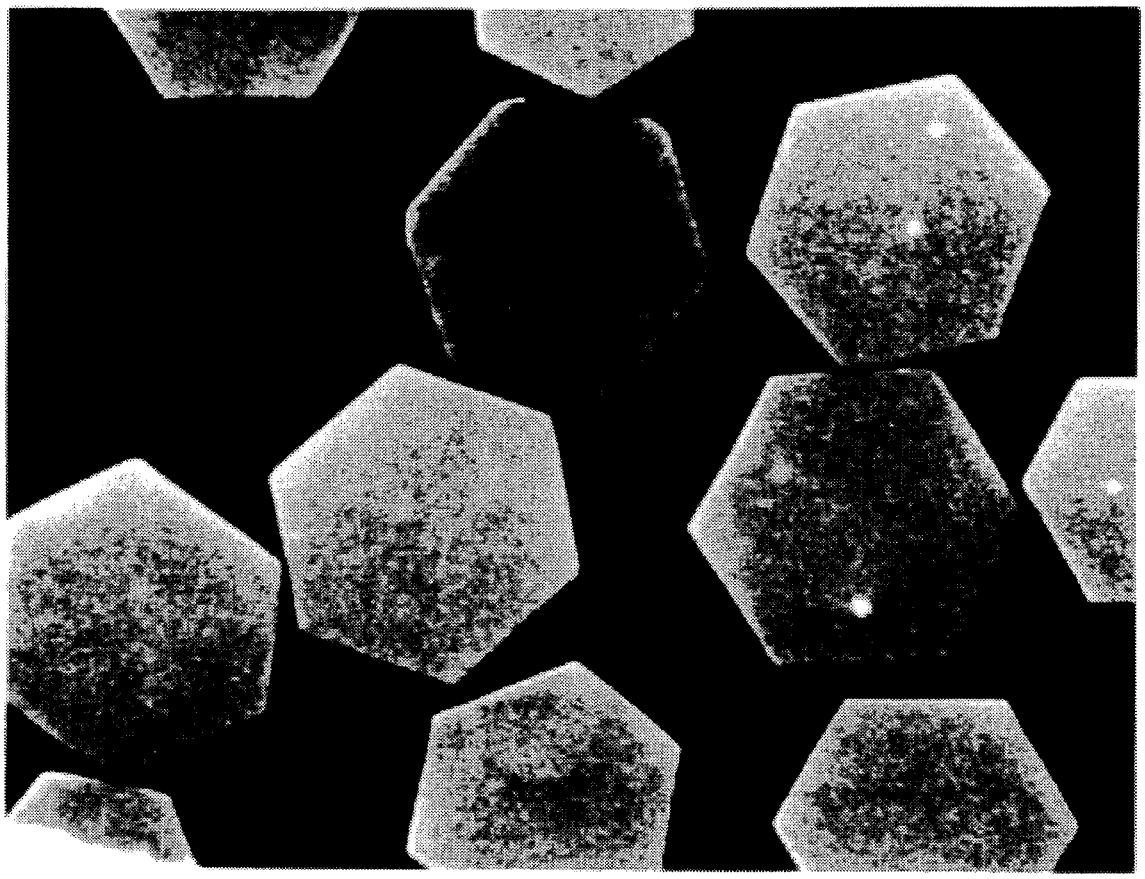
FIG. 5 is a scanning electron micrograph of {111} tabular grains formed in the presence of a grain growth modifier utilized in the present invention, Example 4 (comparative).

The growth modifying effect of Compound S on tabular {111} seed emulsions was examined utilizing a scanning electron microscope. As can be seen in FIG. 5, which illustrates the continued presence of tabular {111} grains in the emulsion, Compound S did not modify grain growth. Thus, it is apparent from Examples 3 and 4 that Compound S is a {111} grain growth modifier; that is, it facilitates formation of {111} crystal faces.

Example 5

Figure 6:
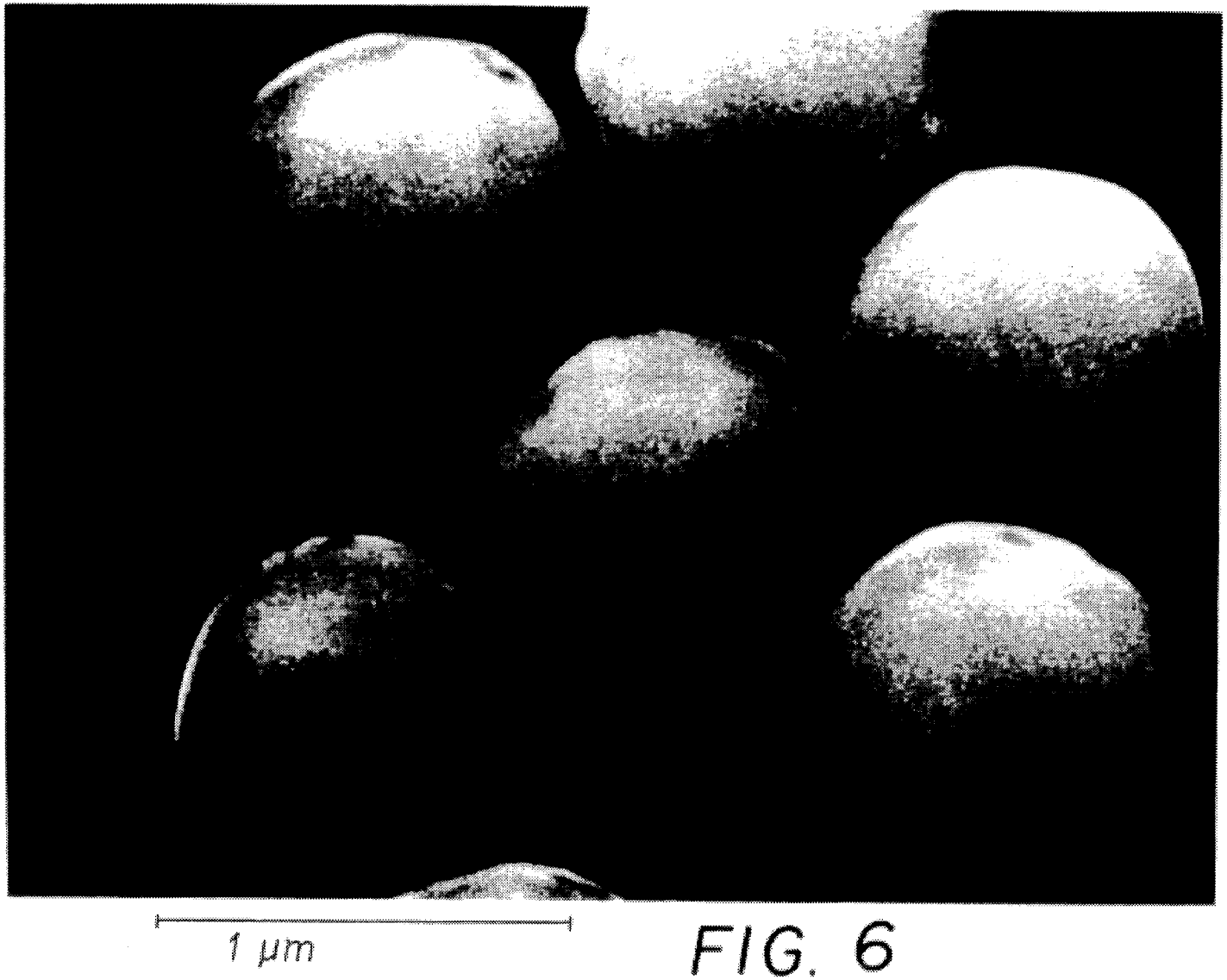
FIG. 6 is a scanning electron micrograph of the grains formed by a fourth preferred embodiment of the invention, Example 5. The grains of FIG. 6 are spherical in morphology.

The invention was performed in accordance with Examples 1–3, except that Compound D was utilized as the grain growth modifier. The result, as seen in FIG. 6, illustrates the formation of a spherical silver bromide emulsion using a cubic silver bromide seed emulsion.

Example 6

Figure 7:
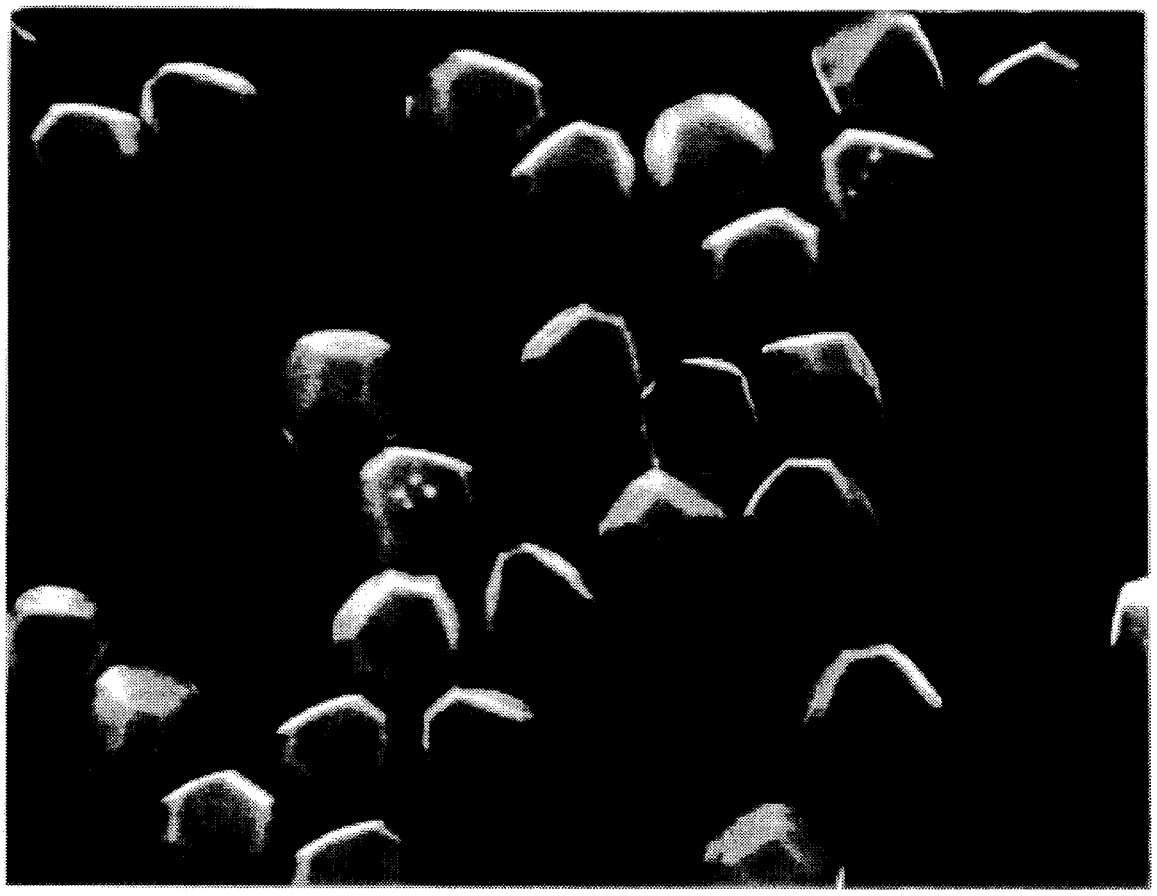
FIG. 7 is a scanning electron micrograph of the grains formed by a fifth preferred embodiment of the invention, Example 6. The grains of FIG. 7 are cubo-octahedral in morphology.

The invention was performed similarly to Examples 1–3, except that Compound L was utilized as the grain grown modifier. The result, as seen in FIG. 7, illustrates the formation of cubo-octahedral grains having six {100} crystal faces and eight {111} crystal faces.

Example 7

This example confirms from Example 6 that Compound L is a {111} grain growth modifier.

Figure 8:
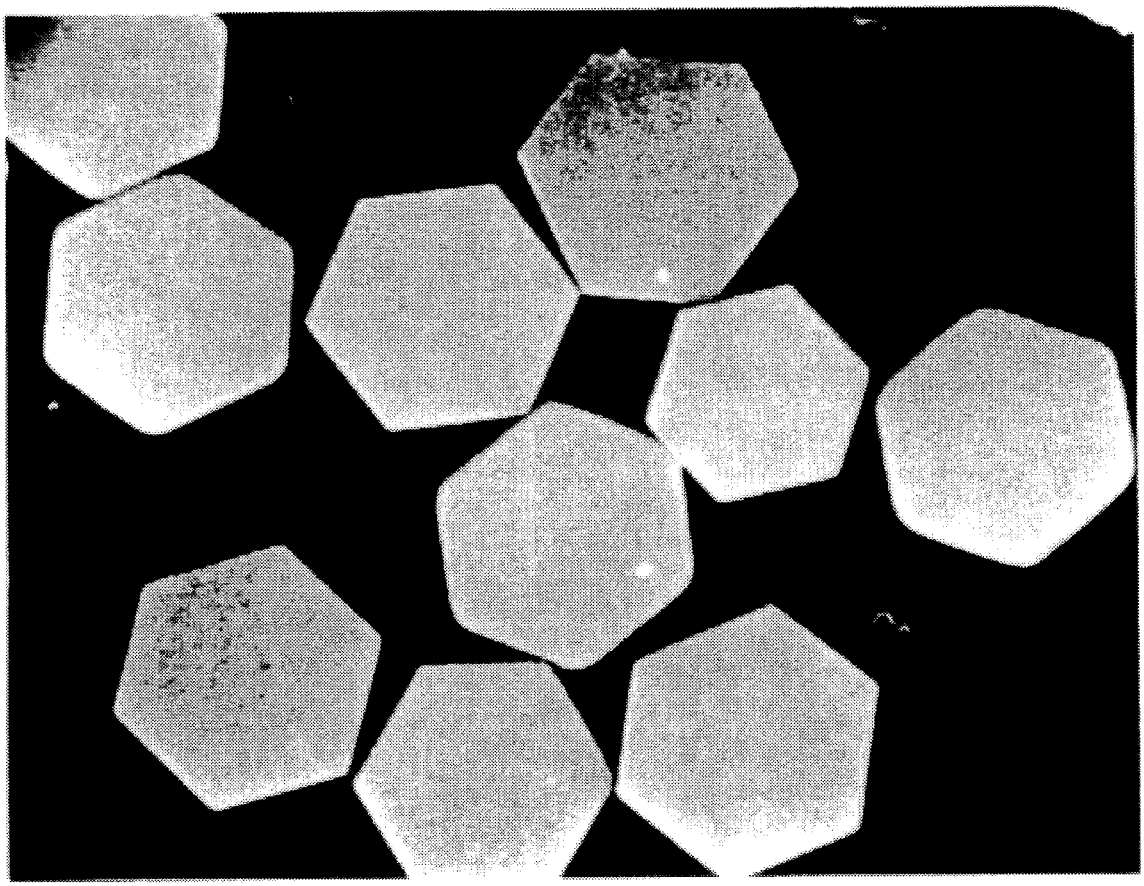
FIG. 8 is a scanning electron micrograph of {111} tabular grains formed in the presence of a grain growth modifier utilized in the present invention, Example 7 (comparative).

The example was performed similarly to Example 4 in which a tabular {111} seed emulsion was utilized. As seen in FIG. 8, Compound L did not modify grain growth. Thus, it is a {111} grain growth modifier.

The invention has been described in detail with particular reference to preferred embodiments thereof, but it will be understood that variations and modifications can be effected within the spirit and scope of the invention.

What is claimed is:

1. A process of preparing a photographic emulsion comprising:

introducing silver ions, halide ions and a grain growth modifier having the structure

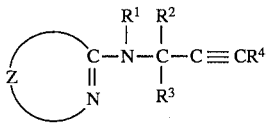

wherein Z represents atoms necessary to complete a five to nine-membered heterocyclic ring system, $R^1$, $R^2$ and $R^3$ independently represent hydrogen or a lower alkyl of from 1 to 5 carbon atoms, and $R^4$ represents hydrogen, or an aliphatic, carbocyclic, or heterocyclic group, which may be substituted or unsubstituted, into a dispersing medium containing silver halide seed grains; and maintaining the dispersing medium containing the seed grains, silver halide, halide ions and grain growth modifier at a pH in the range from about 4.5 to about 10, and a pAg in the range from about 6.0 to about 9.5.

2. A process according to claim 1 wherein the emulsion comprises silver halide grains that are predominantly silver bromide or silver iodobromide.

3. A process according to claim 2 wherein the seed grains are bounded by at least two {100} crystal faces.

4. A process according to claim 3 wherein the seed grains have a cubic or tabular morphology.

5. A process according to claim 4 wherein the amount of grain growth modifier is from about 0.1 to about 100 millimoles per mole silver halide.

6. A process according to claim 5 wherein the grain growth modifier has the structure

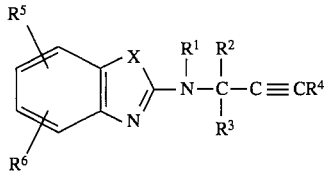

wherein X represents oxygen, sulfur, or selenium, or a substituted or unsubstituted nitrogen; $R^1$, $R^2$, $R^3$ and $R^4$ are as defined in claim 1; and $R^5$ and $R^6$ independently represent hydrogen, a halogen, or a substituted or unsubstituted alkyl or alkoxy group.

7. A process according to claim 6 wherein $R^4$ is other than hydrogen.

8. A process according to claim 6 wherein the grain growth modifier is selected from the group consisting of Compound A:

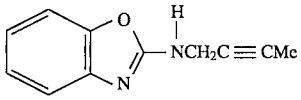

Compound B:

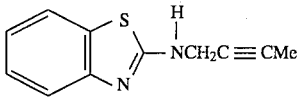

-continued

Compound C:

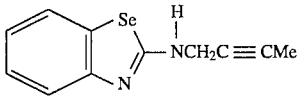

Compound D:

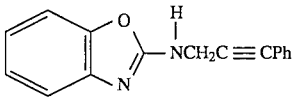

Compound E:

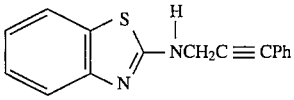

Compound F:

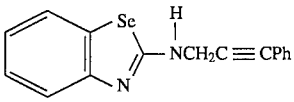

Compound G:

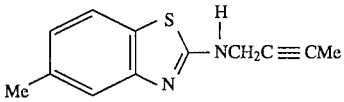

Compound H:

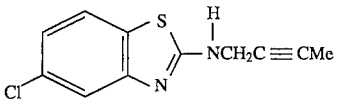

Compound I:

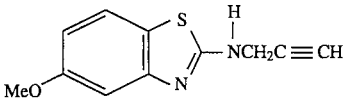

Compound J:

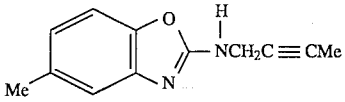

Compound K:

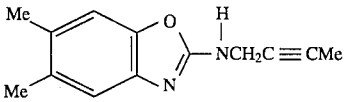

Compound L:

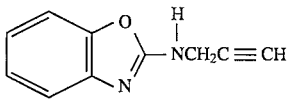

-continued

Compound M:

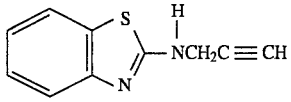

Compound N:

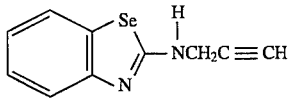

Compound O:

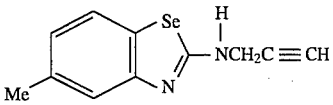

Compound P:

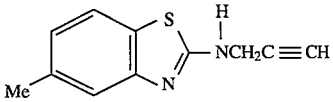

Compound Q:

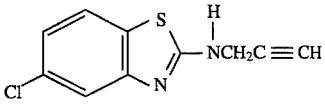

Compound R:

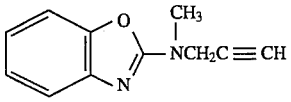

Compound S:

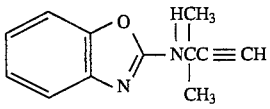

and

Compound T:

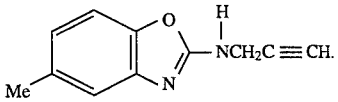

9. A process comprising precipitating silver bromide or silver iodobromide onto cubic silver bromide or silver iodobromide seed grains of a photographic emulsion wherein the precipitation is done in the presence of an amount of grain growth modifier equal to about 0.1 to about 100 millimoles per total mole of silver halide, and the grain growth modifier has the structure:

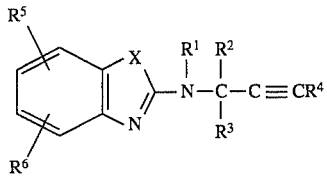

wherein X represents oxygen, sulfur or selenium, or a substituted or unsubstituted nitrogen; $R^1$, $R^2$ and $R^3$ independently represent hydrogen or a lower alkyl of from 1 to 5 carbon atoms; $R^4$ represents hydrogen, or an aliphatic, carbocyclic, or heterocyclic group, which may be substituted or unsubstituted; and $R^5$ and $R^6$ independently represent hydrogen, a halogen, or a substituted or unsubstituted alkyl or alkoxy group.

10. A process according to claim 9 wherein the growth modifier is selected from Compound A:

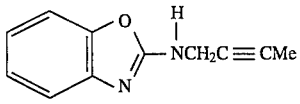

and

Compound R:

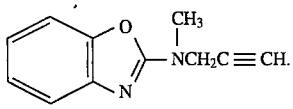

and the precipitation is done in the presence of a sufficient amount of silver, bromide and iodide ions, and for a sufficient time, so as to form silver bromide or silver iodobromide grains having an icositetrahedral morphology.

11. A process according to claim 9 wherein the growth modifier is selected from Compound L:

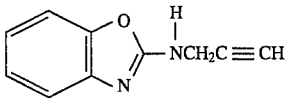

and

Compound S:

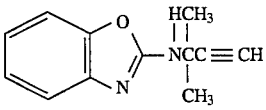

and the precipitation is done in the presence of a sufficient amount of silver, bromide and iodide ions, and for a sufficient amount of time, so as to form silver bromide or silver iodobromide grains having an octahedral or cubo-octahedral morphology.

12. A photographic element comprising a support having incorporated thereon a silver halide emulsion layer, the silver halide emulsion layer comprising silver halide grains internally containing a compound of the formula

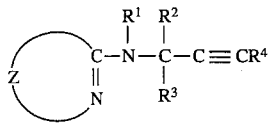

wherein Z represents atoms necessary to complete a five to nine-membered heterocyclic ring system; $R^1$, $R^2$ and $R^3$ independently represent hydrogen or a lower alkyl of from 1 to 5 carbon atoms, with the proviso that at least one of $R^1$, $R^2$ and $R^3$ be a lower alkyl of from 1 to 5 carbon atoms; and $R^4$ represents hydrogen, or an aliphatic, carbocyclic, or heterocyclic group, which may be substituted or unsubstituted.

* * * * *